US011066136B1

(12) United States Patent
Guild et al.

(10) Patent No.: US 11,066,136 B1
(45) Date of Patent: Jul. 20, 2021

(54) PONTOON BOAT WITH ADJUSTABLE EXTENSION SYSTEM

(71) Applicant: C.L. Guild Co. Inc., Wilton, NH (US)

(72) Inventors: Curtis L Guild, Wilton, NH (US); David Merton Gray, Rindge, NH (US); Joseph James Gottstein, Wilton, NH (US)

( * ) Notice: Subject to any disclaimer, the term of this patent is extended or adjusted under 35 U.S.C. 154(b) by 0 days.

(21) Appl. No.: 17/068,250

(22) Filed: Oct. 12, 2020

(51) Int. Cl.
*B63B 1/22* (2006.01)
*B63B 35/36* (2006.01)
*B63B 3/48* (2006.01)

(52) U.S. Cl.
CPC ..... *B63B 35/36* (2013.01); *B63B 3/48* (2013.01); *B63B 2003/485* (2013.01)

(58) Field of Classification Search
CPC ..... B63B 3/48; B63B 2003/485; B63B 35/36; B63B 7/00; B63B 2007/003
USPC ..... 114/61.15, 61.16, 284
See application file for complete search history.

(56) References Cited

U.S. PATENT DOCUMENTS 3,099,977 A * 8/1963 McLarty ..... B60F 3/0092 114/61.15
3,802,006 A * 4/1974 Nelson ..... B60F 3/0092 114/344
3,877,094 A * 4/1975 Kelley ..... B63B 2035/4426 114/344
6,564,735 B1 * 5/2003 Jackson ..... B63B 35/36 114/353
6,698,371 B1 * 3/2004 Stoltzfus ..... B63B 35/58 114/61.1

* cited by examiner

*Primary Examiner* — Daniel V Venne
(74) *Attorney, Agent, or Firm* — Sarita Pickett; Patent Negotiator, PLLC

(57) ABSTRACT

The present invention relates generally to watercraft vehicles, and more particularly, to adjustable pontoon boats. More specifically to adjustable pontoons and a deployment system capable of connecting and altering positions of the adjustable pontoons with respect to a pontoon boat.

10 Claims, 8 Drawing Sheets

PONTOON BOAT WITH ADJUSTABLE EXTENSION SYSTEM

BACKGROUND OF THE INVENTION

1. Field of the Invention

The present invention relates generally to watercraft vehicles, and more particularly, to pontoon boats.

2. Description of the Prior Art

U.S. Pat. No. 7,987,803 by Lang discloses a pontoon boat which includes a deck, a pair of pontoon floats, an elongated channel member and a boat. The pair of pontoons is disposed on a water side portion of the deck for supporting the deck above a water level.

A pontoon boat may refer to any type of boat supported by pontoons or floats. Generally, a pontoon boat may include one or more structures above the water. The term 'structure' may refer to a simple platform similar to a raft, a deck, or even a house-like structure similar to a houseboat. The pontoon boat also generally includes a deck and at least one pontoon. Pontoons may be constructed from closed cylinders such as pipes and barrels.

SUMMARY OF THE INVENTION

Advantages and Differences of Invention Over Known Prior Art

There are many islands within the United States which are only accessible by boat except in the deep winter when the lake is covered with thick ice. Moving materials and equipment to these islands for building repairs has always proven to be a challenge.

Over the years, different individuals have fashioned various types of raft that can accommodate small equipment and a small amount of materials. These rafts are either pushed or pulled by a motorboat. This is not an efficient practice, not to mention, it can be stressful and time consuming. One option for improving upon this system was a boat with pontoons for the purpose of crossing small bodies of water.

Pontoon boats with a flat deck are optimal for transporting large farm equipment (such as small tractors, etc.) to and from various land masses. Due to the weight requirements for moving some of the heavier equipment, additional pontoons were needed to increase floatation (buoyancy) beyond what is common with a two-pontoon vessel. However, increasing the number of pontoons naturally increases the width of the vessel overall.

Specifically, the Department of Transportation (DOT) limits the width of anything traversing roads to a certain width. In order to allow mobility between various water systems and not just land masses, a system needed to be built in such a way as to enable compliance with the DOT maximum road width regulations. Width limits and other provisions have been adopted for six types of specialized equipment: automobile and boat transporter combinations are one of these. Generally though, the Federal government Federal Aid Highway Act of 1956 provided a maximum vehicle width of 96 inches (2.44 meters) on the interstate highway system. The maximum width limit for commercial motor vehicles on the highway system was originally established at 102 inches, except for Hawaii where it is 2.74 m (108 inches). To standardize vehicle width on an international basis, the 102-inch width limit was interpreted to mean the same as its approximate metric equivalent, 2.6 meters (102.36 inches).

It was necessary to create a system that would make the process of transporting large equipment across bodies of water more efficient, yet also facilitating transporting these same systems via national highways, i.e., keeping the boat within the width required by the DOT regulations.

The present invention achieves these and other objectives by providing an adjustable pontoon system for a pontoon boat with a main deck and at least two pontoons. The adjustable pontoon system has an adjustable pontoon capable of being positionally adjusted with respect to the main deck of the pontoon boat. The adjustable pontoon system has a lift arm having a first end and a second end opposite the first end. The first end of the lift arm is secured to the main deck of the pontoon boat and the second end of the lift arm is fixed secured to and supports the adjustable pontoon.

The adjustable pontoon system also has a deployment system which facilitates movement of the lift arm with respect to the main deck of the pontoon boat. Due to the attachment to the adjustable pontoon, movement of the lift arm translates into movement of the adjustable pontoon from a first position to at least a second position.

This ability to move the adjustable pontoon from one position to another position means that the adjustable pontoon system itself has a first configuration in which the lift arm extends at an angle to the main deck of the pontoon boat, and a second configuration in which the lift arm extends parallel to the main deck of the pontoon boat.

The adjustable pontoon system may also have at least one deck extension which may also be supported by the second end of the lift arm. Due to the connection on the second end of the lift arm, this deck extension is also capable of being adjusted with respect to the main deck of the pontoon boat. Altogether then, the single motion of the second end of the lift arm translates into movement of the adjustable pontoon and also the deck extension from a first position to a second position. In this embodiment of the pontoon system, when in the first configuration, the deck extension extends abnormal to the main deck of the pontoon boat, and in the second configuration the deck extension extends parallel to the main deck of the pontoon boat.

In some embodiments, the movement of the deployment system is activated or facilitated by a piston capable of activating the deployment system thereby facilitating rotation of the deployment system about at least one rotation point. The adjustable pontoon system may also have a locking mechanism capable of securely locking, holding, and maintaining the adjustable pontoon system in at least one of the first and second configurations.

The present inventive system may also be prebuilt within an adjustable pontoon boat, so that the adjustable pontoon boat itself has a nonadjustable pontoon having a first width and a first length, a main deck having a first width and a first length, and an adjustable pontoon system. The adjustable pontoon system would again have an adjustable pontoon capable of being positionally adjusted with respect to the main deck of the pontoon boat. At least one deck extension may be reversibly connected to the at least one adjustable pontoon. A deployment system is present which is capable of facilitating movement of the at least one adjustable pontoon and the at least one deck extension from a first position to a second position, such that the adjustable pontoon system has a first configuration in which the at least one deck extension extends abnormal to the main deck of the pontoon boat, and a second configuration in which the at least one deck extension extends parallel to the main deck of the pontoon boat.

Pontoon boats typically have a main deck with at least a first non-adjustable pontoon. The present invention achieves the main objectives by providing a method of adjusting a width of a pontoon boat. The present invention does this initially, by providing an adjustable pontoon system which has an adjustable pontoon, and a deployment system.

By activating the deployment system, the adjustable pontoon system can facilitate movement of the adjustable pontoon. Specifically, the deployment system alters a position of the adjustable pontoon relative to the main deck from a first position to a second position thereby altering an overall width of the pontoon boat with the adjustable pontoon system as a whole from a first width to a second width. In some cases, the overall width of the pontoon boat being adjusted as much as 10%, 20%, 50%, or even, in some cases, by as much as 75%.

This is possible because the method further includes providing the adjustable pontoon system which is capable of supporting the adjustable pontoon on a rotatable lift arm of the deployment system. Next, connecting the lift arm to the main deck by at least one pivot, so that the lift arm can be rotated about that pivot. Then, when the piston is activated, the piston acts upon the lift arm, and the lift arm is rotated around the at least one pivot by at least 30 degrees. In some instances, the pivot rotates further, as much as 160 degrees rotation.

In this manner, the adjustable pontoon can be rotated from a first position which increases an overall width of the pontoon boat to a second position which decreases the overall width of the pontoon boat. The percentage of alteration in width being related to the relative sizes of the adjustable pontoon to the overall boat.

DETAILED DESCRIPTION OF THE INVENTION

Figure 1:
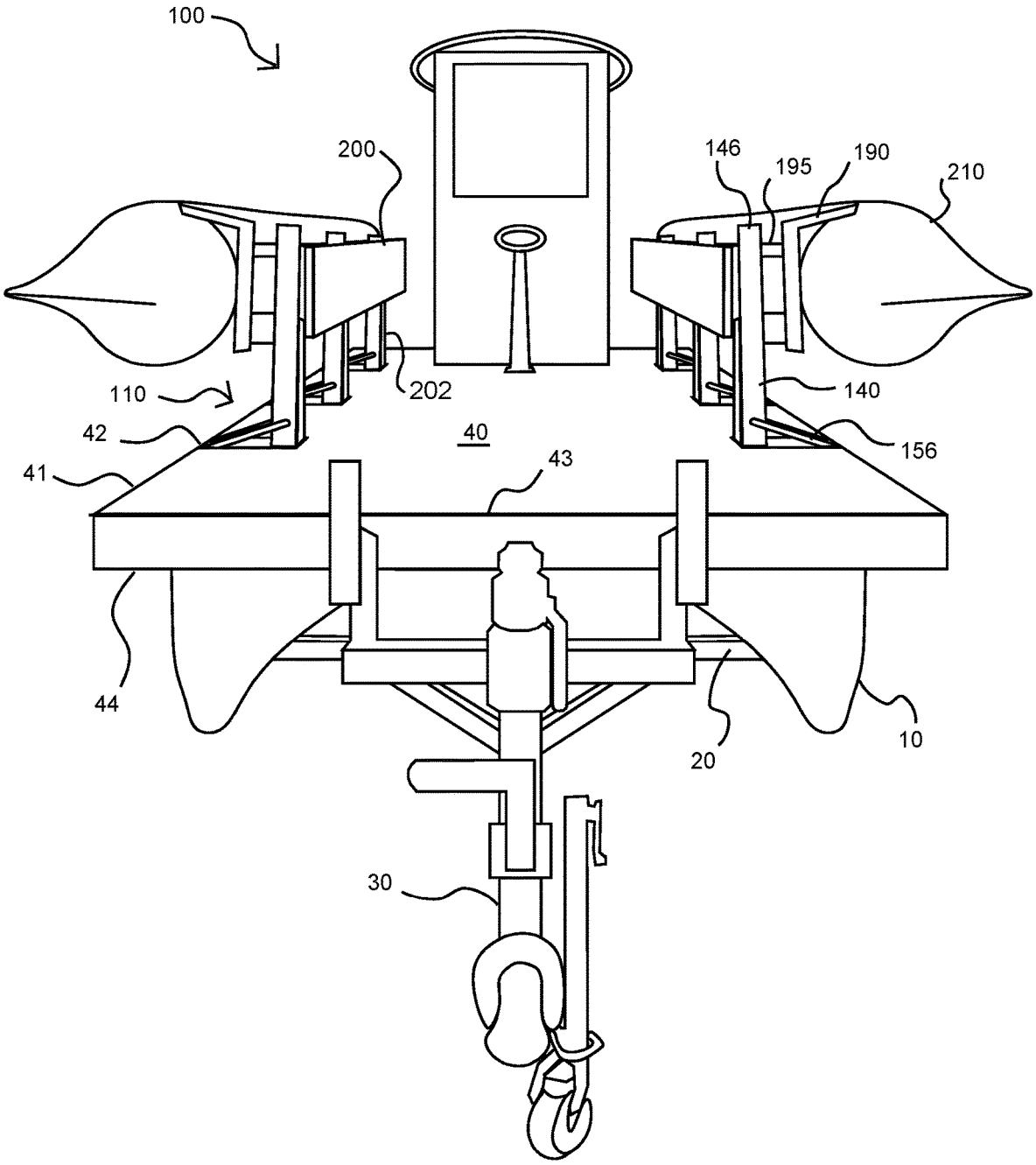
FIG. 1 is a front view of one embodiment of the pontoon system of the present invention with pontoons in a first traveling configuration for traveling.

The preferred embodiment of the present invention is illustrated in FIGS. 1-9. Specifically, FIG. 1 illustrates one embodiment of the pontoon boat 100 of the present invention with a front 43 facing forwards having pontoons 210 in a first configuration for traveling. In the first configuration, the deployment system 110, deck extensions 200, and additional pontoons 210 are folded back so as to be positioned at an angle with main deck 40 of the pontoon boat 100. The pontoon boat is shown here supported on a traditional trailer 20 for transport via hitch 30 connected on the reverse of any typical motorized vehicle.

The deck 40 of the pontoon boat 100 has been modified with apertures 142 in this embodiment and retrofitted with the deployment system 110. The deployment system 110 in turn supports the deck extensions 200 and additional pontoons 210 via pontoon support shafts 190 and decking support 195.

Figure 7:
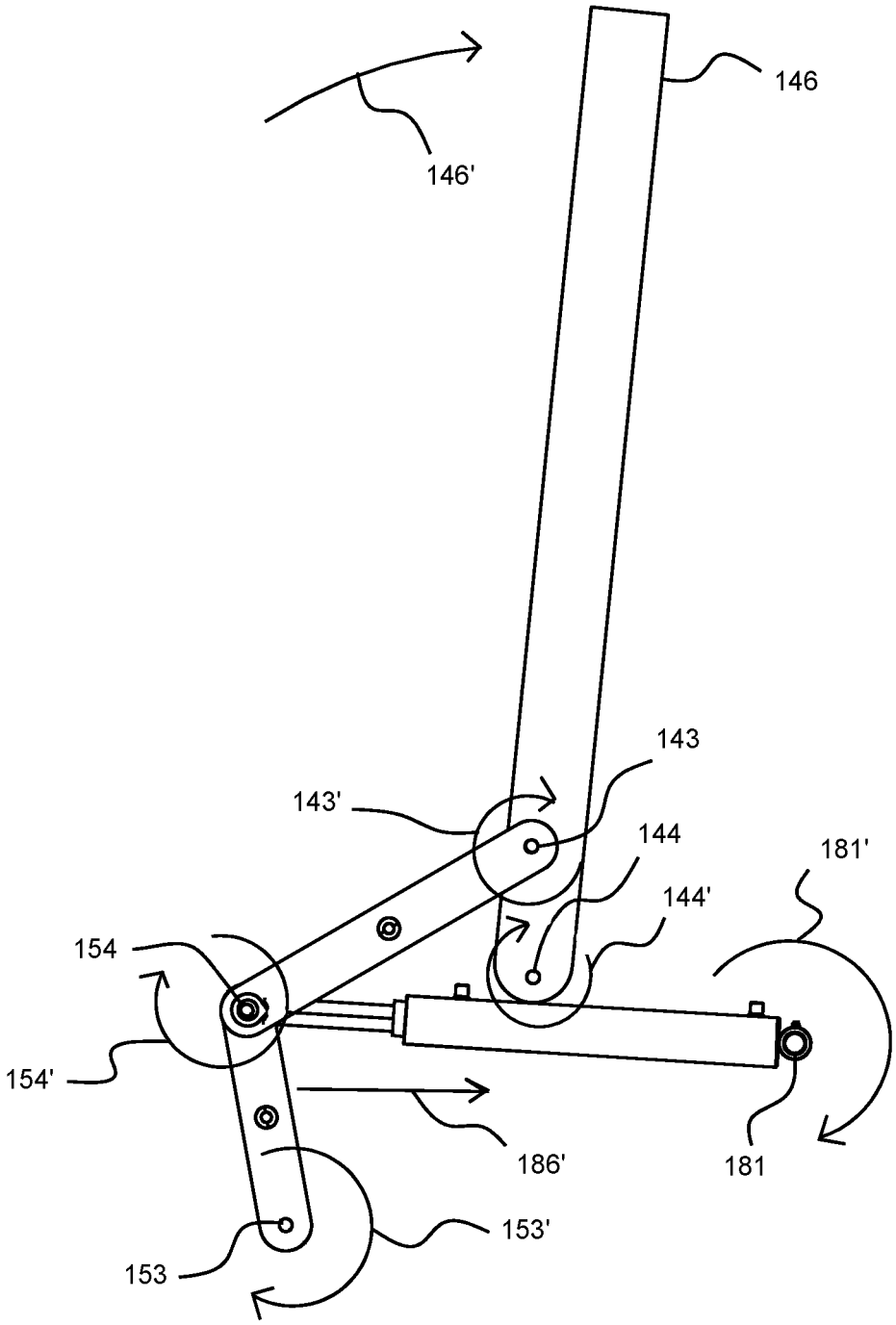
FIG. 7 is a front view of the interacting components of the deployment system of FIG. 3 shown in the first traveling position, associated with the first configuration of FIG. 1.
Figure 8:
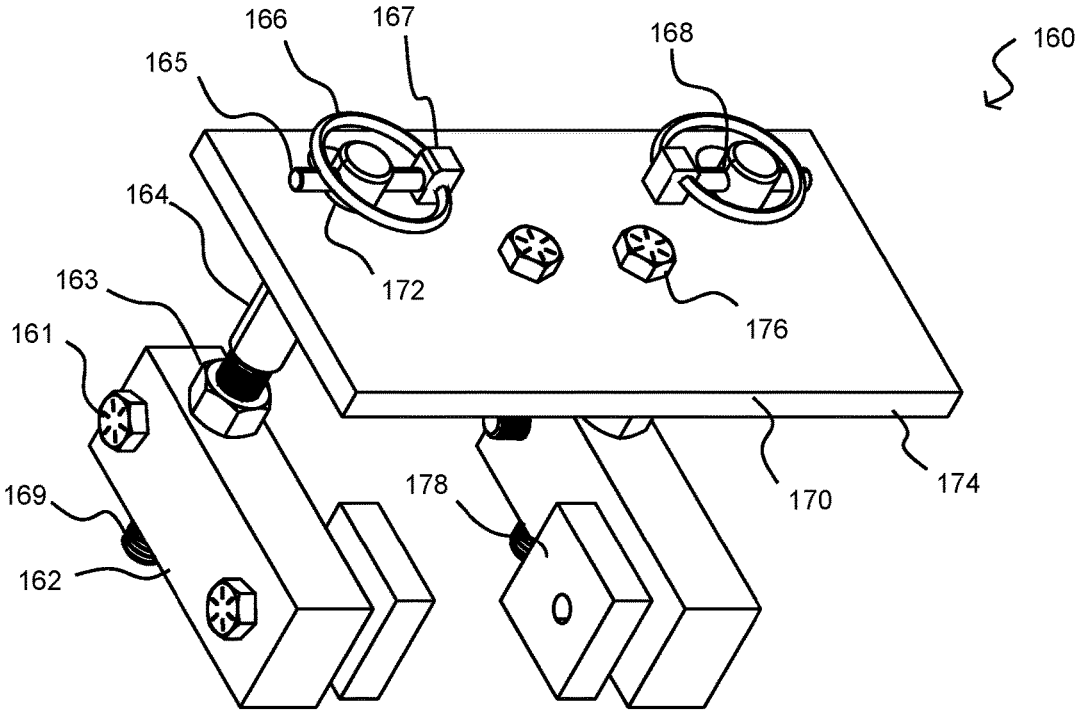
FIG. 8 is an upper perspective view of the interacting components of the locking mechanism of FIG. 1 shown in the second configuration.
Figure 9:
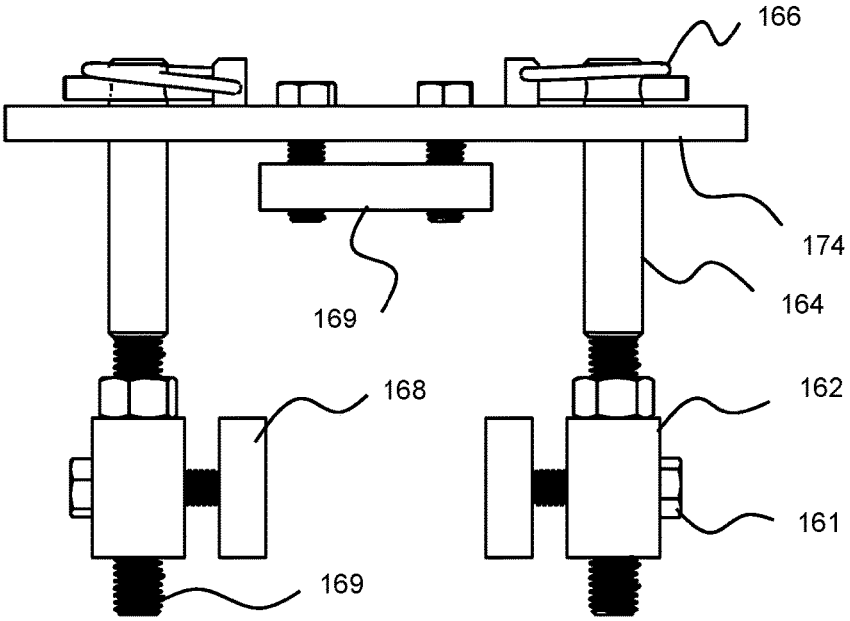
FIG. 9 is a front view of the interacting components of the locking mechanism of FIG. 1 shown in the second configuration.

Most of the deployment system 110 cannot be seen in this figure except for long link 156 and lift arm 140. The lift arm 140 has a first end 146 connected to decking support 195. In this figure, the lift arm 140 is shown at a 90-degree angle with respect to the main deck 40, however in many embodiments (such as shown in FIG. 7), the first configuration actually employs an angle closer to 140-degrees so that the furthest edge of the pontoon is brought in over the deck 40. In this manner, the width of the pontoon from side to side extends no further than from left side 41 to right side 41' of the deck 40.

Figure 2:
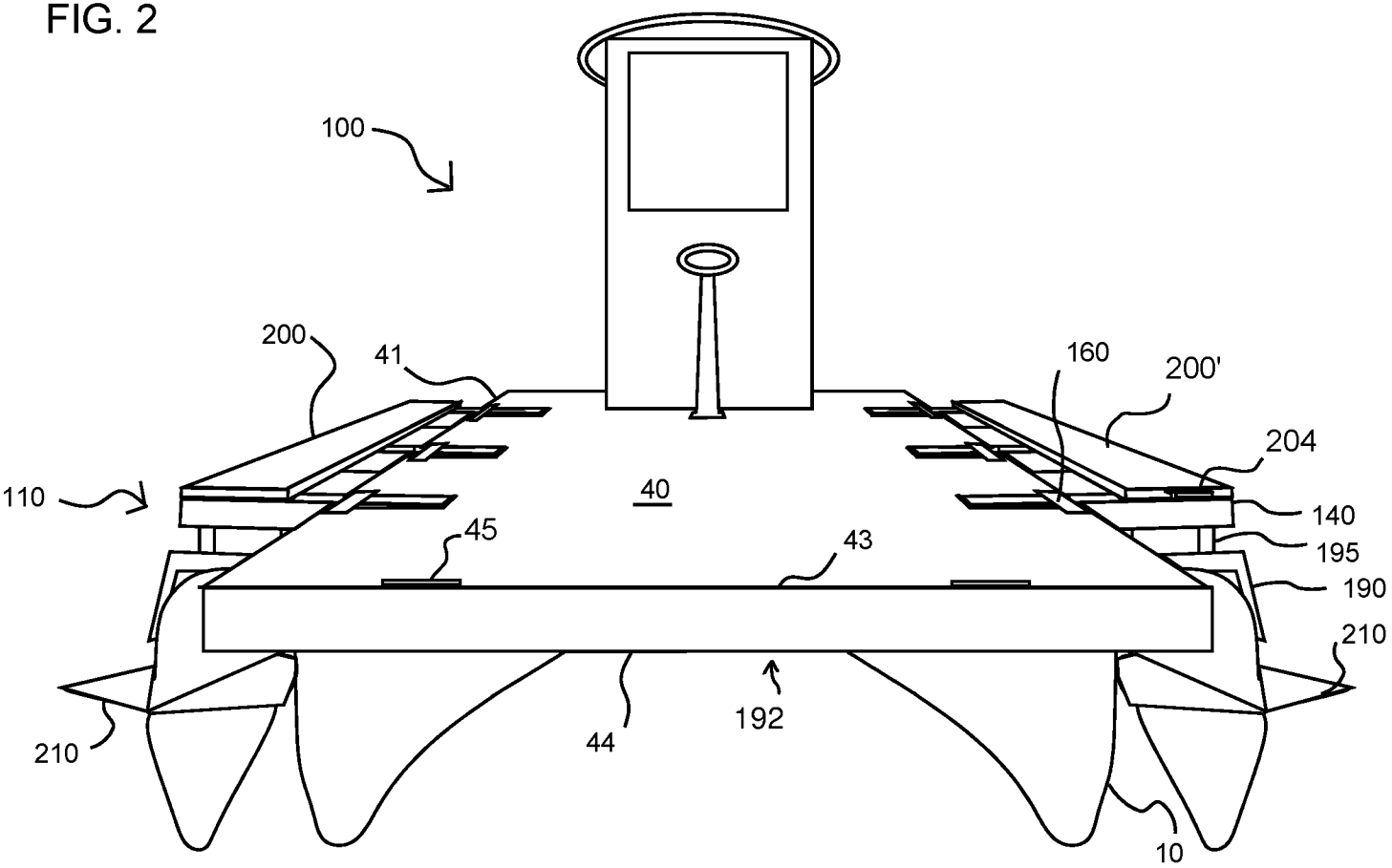
FIG. 2 is a front view of the embodiment of the pontoon system of FIG. 1 with pontoons in a second use configuration for use, with an additional optional pontoon alternative.
Figure 3:
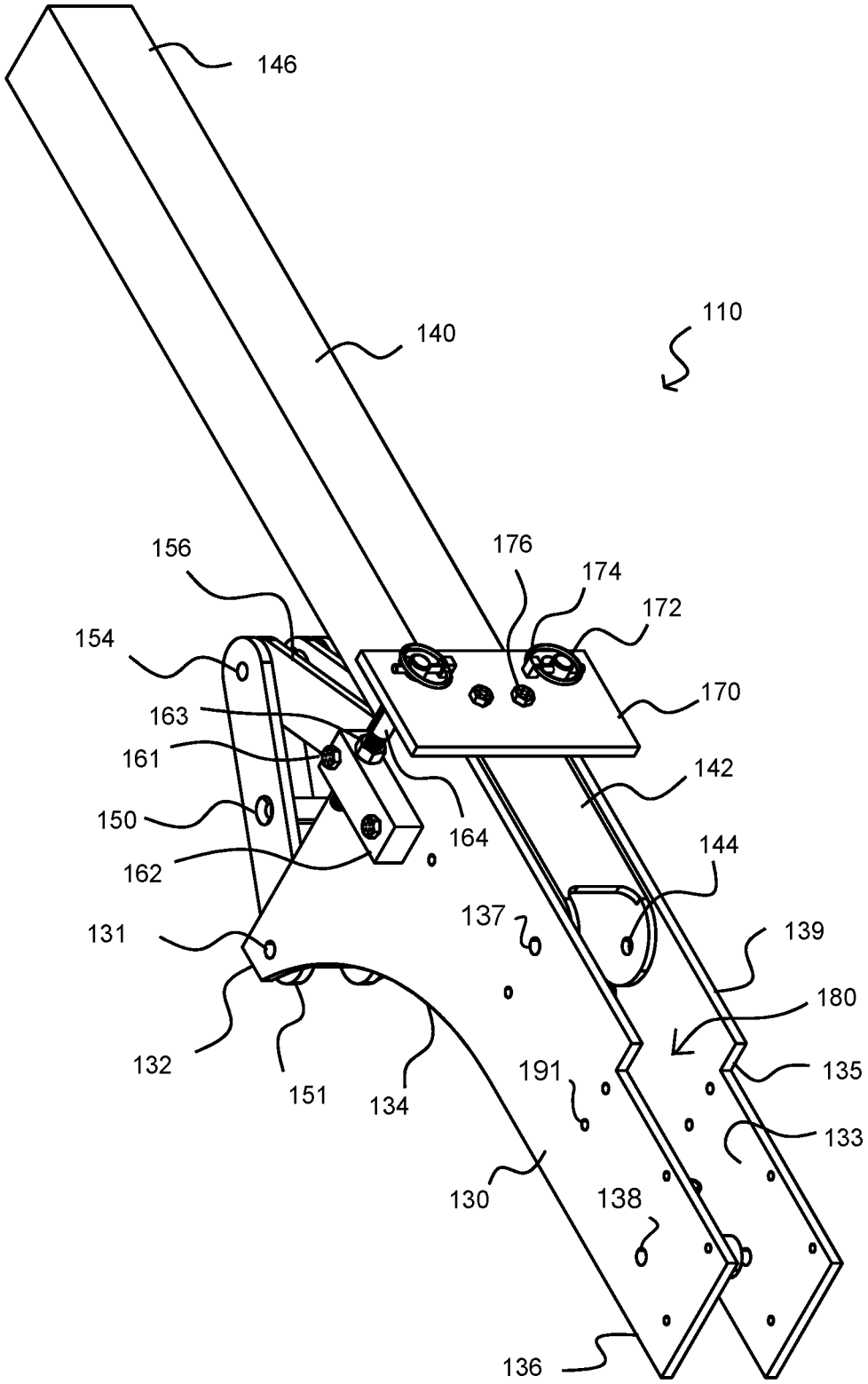
FIG. 3 is a perspective view of the deployment system in the second use position of the pontoon system shown in FIG. 2 shown in the second configuration.

Next, FIG. 2 illustrates the pontoon boat 100 of the present invention with a front 43 facing forwards having pontoons 210 in a second configuration for sailing. In the second configuration, the deployment system 110, deck extensions 200, and additional pontoons 210 are extended outwards so that an upper surface of the deck extensions 200 is positioned parallel with an upper surface of the main deck 40 of the pontoon boat 100. The deck 40 of the pontoon boat 100 has been modified with apertures 142 in this embodiment and retrofitted with the deployment system 110. The deployment system 110 in turn supports the deck extensions 200, 200' and additional pontoons 210 via pontoon attachment connecting shafts 190 and connecting shafts 195.

Most of the deployment system 110 cannot be seen in FIG. 2 except for locking mechanism 170 and lift arm 140. However, the lift arm 140 can be seen with a first end 146 connected to attachment bars 195. In this embodiment, the lift arm 140 is parallel to and coplanar with, the main deck 40. However, in other embodiments, the lift arms 140 are slightly lower than, and not coplanar with, the main deck 40 in order to make an upper surface of the deck extensions 200 coplanar with the upper surface of the main deck 40. As explicitly shown in FIG. 1 and FIG. 2, while the present inventive system moves from the first configuration to the second configuration, the main deck 40 itself remains fixed and nonadjustable.

Pontoons 10 and Adjustable Pontoons 210

Most pontoon boats have between two and four fixed pontoons 10 which have diameters that range between 24 inches to 36 inches. The adjustable pontoons 210 are distinct from these fixed pontoons 10, being completely disparate from the main deck 40, and also have diameters that range between 24 inches to 36 inches.

The fixed pontoons 10 of a pontoon boat may have a length of between 120 to 324 inches. The adjustable pontoons 210 similarly have a length of between 120 to 324 inches, and more preferably a length of about 144 inches. It is to be understood that the length of the adjustable pontoons 210 may be greater than the length of the fixed pontoons 10 so long as the piston 180 is of sufficient strength to support the additional weight.

For a pontoon 10 with a 12-foot length, 1-foot width, and 2-foot height, the volume is 24 cubic feet. By multiplying the volume of the pontoon by the weight of water (62.4 pounds per cubic feet) the weight of the water displaced by the pontoon is calculated, and thus, an upper limit of weight of the water displaced before the pontoon sinks. For safety reasons, the pontoons should only be half immersed, so the effective limit of weight is half of the upper limit. For small pontoon boats having a combined pontoon volume of 72 cubic feet (three pontoons with 24 cubic feet each), the weight limit is then half of 4500 pounds (roughly 2000 kg), or about 2,250 pounds (roughly 1000 kg). For a smaller boat like this, a total weight might be around 1,800 pounds including the motor. Once the weight of the pontoon boat itself is factored in, most small pontoon boats of this size can only hold an additional 450 pounds of people and gear safely.

If the pontoon boat is larger and has pontoons which are longer or wider, the overall volume increases, and the amount of weight supported increases. For example, for a pontoon 10 having a 20-foot length and 2-foot diameter, an overall volume would be 62.8 cubic feet. If the pontoon boat had three of these larger pontoons, then the effective safe buoyancy is one half the total displaced weight of the water, roughly about 5,800 pounds. However, larger pontoon boats weight more, between 3,500-4,800 pounds (wet weight) when including the motor. The fuel tanks for these engines tend to be a bit larger and range from 24 gallons to 50 gallons. Again, once the weight of the pontoon boat, fuel, etc., itself is factored in, even these slightly larger pontoon boats can only hold, on average, an additional approximate 1,400 pounds of people and gear safely. Again, too much wider or longer, and these pontoon boats will no longer be able to be transportable on the open highway.

The present invention seeks to address this disparity by providing a system for increasing the overall weight which can be supported by a pontoon boat. For example, being able to support most standard utility farm tractors, small excavators, or other small-to-medium sized heavy equipment machinery with a horsepower between 10 and 75, or more preferably between 20 to 30. Even these 'small' heavy equipment machines will weigh on average, between 1,000 kilograms and 5,000. Larger heavy pieces of equipment can weigh even more.

In order to be able to easily transport these larger and heavier pieces of equipment, the present invention sought to provide a way to double the effective buoyancy of the pontoon boat without increasing the width of the pontoon boat while driving on the highway. By using the proposed system, the present invention increases the overall effective pontoon buoyancy between 25 to 200 percent, and more usually, about 100 percent in order to meet this need. Specifically, for a pontoon boat with two small pontoons, adding two larger adjustable pontoons can double the overall effective pontoon buoyancy about 200 percent by increasing the buoyancy without drastically increasing the overall weight, length, or transporting width of the boat.

Deployment System 110

Discussed next with reference to FIGS. 3-7 are elements of the deployment system 110 which facilitates the rotation and adjustment of the deck extensions 200 and additional pontoons 210 from the first configuration to the second configuration. Starting with FIG. 3, which is a perspective view of the deployment system of FIG. 1, shown in the second configuration (as in FIG. 2). The deployment system 110 includes side plates 130, lift arm 140, first and second links 150, lock 160, 170, and piston 180. In some embodiments, a shaft extends lengthwise underneath the deck 40 and attaches a first deployment system 110 to a second deployment system 110 on opposing side of the main deck 40.

Connecting Plates 130 and Shafts 190

When installed, a first end 132 of the plate 130 faces the outward side 41 of the deck 40 and has a first plate pivot aperture 131 which corresponds to a first short link pivot 153 and associated bolt. A second end 136 of the plate 130 extends underneath the deck 40 and has a second plate aperture 138 which corresponds to a piston pivot 181 and associated bolt. The upper surface 139 of the plate 130 has an indenture 135 to meet and correspond to another portion along an underside of the deck 40. About half-way along the plate 130, a third pivot aperture point 137 corresponds to a lift arm second pivot 144 point which also has a corresponding bolt.

A further series of apertures 191 are present along the plate 130 for securing the plates to the adjacent portions of the deck 40 on either side of the deck aperture 42 and to the connecting horizontal hollow bar 192. A lower surface 134 of the plate leading from the first end 132 to the opposing second end 136 is curved gradually in this embodiment. However, it is to be understood that this could be a series of stepwise straight edges, or a single straight edge. Likewise, instead of providing the indent 135 positioned towards the opposing second end 136, the entire plate 130 could be a four-sided plate which is rectangular or trapezoidal in shape. In this embodiment, the indent 135 is a relief designed particularly to meet certain decking 40 standards.

With regard to dimensions, in one embodiment, a first series of apertures of the plate 130 is a plurality of six apertures which are between 0.7-0.1 inches, preferably between 0.4 and 0.2 inches, and more preferably, about 0.3 inches in diameter. A second series of apertures is a plurality of three apertures which are between 0.5-0.1 inches, preferably between 0.4 and 0.2 inches, and more preferably, about 0.26 inches in diameter. A third series of apertures is a plurality of three apertures 131, 137, 139 extending through the plate 130 having a diameter of between 0.8-0.2 inches, preferably between 0.7 and 0.4 inches, and more preferably, about 0.500 inches.

Made of aluminum 6061, a precipitation-hardened alloy containing magnesium and silicon with a T6 treatment, the thickness of the plate sheet 130 is between 0.7-0.2 inches, preferably between 0.5 and 0.3 inches, and more preferably, about 0.375 inches. The length of the plate 130 from an outermost edge along or adjacent the first end 132 to an innermost edge along or adjacent the second end 136 is between 36-12 inches, preferably between 30 and 20 inches, and more preferably, about 24 inches. The height of the plate 130 from a lowermost edge along or adjacent the first end 132 to an uppermost edge 139 is between 24-6 inches, preferably between 20 and 10 inches, and more preferably, about 12 inches.

The connecting plates 130, when distinct or disparate elements from the deck 40, enable the deployment system 110 to be sold separately and integrated in an aperture 42 in a pre-manufactured pontoon boat 100. However, for a deployment system 110 which comes pre-integrated in a pontoon boat 100 before sale, it is to be understood that the plates 130 may merely be side wall portions on either side of the aperture 42 in the deck 40. In these embodiments, the third series of apertures including a plurality of three apertures 131, 137, 138 are still present for each of the associated pivot points. Likewise, at least two apertures 191 associated with securing the locking mechanism 160 are also present.

In some embodiments, most of the small apertures 191 visible on the side of connecting plates 130 are associated with securing the connecting plates 130 to hollow bars (rods, shafts, columns, or pipes) 190, 191, 192, 195. The horizontal hollow bars 195 which extend horizontally through the Z-channel of the deck 40, extend across and underneath the deck 40 from the left side 41 to the right side 41.' When connecting two opposing deployment systems 110, each deployment system 110 can serve as a counterbalance and weight support to the other during deployment or movement of the adjustable pontoons 210.

In this embodiment, the connecting plates 130 each lay substantially within a corresponding singular plane as they extend parallel to internal side walls along the aperture of the deck 40. However, in some embodiments, apertures 42 do not extend upwards through the upper surface of the main deck 40. In these embodiments, the plates may have a bent configuration so as to secure the deployment system 110 which is positioned underneath the deck 40.

Lift Arm 140

The lift arm 140 of the deployment system 10 has a first end 146 at an outermost edge which supports the deck extension 200 on an uppermost surface. The first end 146 of the lift arm 140 is also fixedly attached via bolts or welding to attachment bars 195 which are in turn fixedly attached to support brackets 190. These support brackets 190 are in turn fixedly attached to the pontoons 210. These pontoons 210 are made adjustable through this fixed attachment to the lift arm 140.

Specifically, the pontoons 210 are adjustable because lift arm 140 can rotate 143' about the second end 142 of the lift arm 140. The links 150 push up 143' against the lift arm 140 where they are connected at pivot point 143. The pressure 143' from the links 150 cause the second end 142 of the lift arm 140 to rotate 144' about pivot point 144 because the lift arm 140 is rotatably connected 144' at pivot point 144 via bolt to the plates 130 at pivot point aperture 137.

During use, the locking mechanism 160 is attached to the lift arm 140 through apertures 145 along the uppermost surface of the lift arm adjacent the second end 142. When locked, this prevents inadvertent pressure from the links 150 to push the pontoons 210 out of place during use.

Made of aluminum 6061 a precipitation-hardened alloy containing magnesium and silicon with a T6 treatment, the lift arm 140 is generally a hollow rectangular shaft with a thickness of between 1.0-0.1 inches, preferably between 0.8 and 0.3 inches, and more preferably, about 0.5 inches. The length of the lift arm 140 from an outermost edge along or adjacent the first end 146 to an innermost edge along or adjacent the second end 142 is between 46-20 inches, preferably between 40 and 30 inches, and more preferably, about 38.6 inches. The height of the lift arm 140 is between 6-1 inches, preferably between 5 and 2 inches, and more preferably, about 3 inches. The width of the lift arm 140 is between 6-1 inches, preferably between 5 and 2 inches, and more preferably, about 3 inches.

The apertures 143, 144, 145 each extend through one of the sides of the lift arm 140 into a hollow interior. The apertures 143, 144, 145 each having a diameter of between 0.8-0.2 inches, preferably between 0.7 and 0.4 inches, and more preferably, about 0.5 inches.

The lift arm 140 has a first vent 147 along an upper surface at the second end 142 which meets a second vent 148 along an opposing lower surface at the second end 142. Together, the first vent 147 and the second vent 148 meet so that the hollow interior of the lift arm 140 is open to receive a portion of at least one of the links 150 along the bottom of the lift arm 140. The first vent 147 has a length of between 6-0.2 inches, preferably between 5 and 1 inches, and more preferably, about 2 inches. The second vent 148 has a length of between 18-8 inches, preferably between 14 and 10 inches, and more preferably, about 12 inches.

Links 150, 156

The short link 150 has a first end 151 with a first pivot 153, and a second end with a second pivot 154. The long link 156 has a first pivot 155 and a second pivot 158. The first short link pivot 153 corresponds to the first pivot 131 at the first end 132 of the plate 130. The second short link pivot 154 corresponds to the first long link pivot 155. The second long link pivot 158 corresponds to lift arm pivot point 143.

The long link 156 has a length of between 16 and 8 inches, preferably between 14 and 10 inches, and more preferably, about 12 inches. The thickness of the long link 156 is between 0.7 and 0.2 inches, preferably between 0.5 and 0.3 inches, and more preferably, about 0.375 inches. The short link 150 has a length of between 14 and 6 inches, preferably between 12 and 8 inches, and more preferably, about 9 inches. The thickness of the short link 150 is between 0.7 and 0.2 inches, preferably between 0.5 and 0.3 inches, and more preferably, about 0.375 inches.

In the embodiment shown here, there are short and long links. However, it is also possible in other embodiments to provide only a single link which is acted upon by the shaft 186 of the piston 180. Similarly, it is in the scope of the inventive concept to provide alternatives beyond that shown in the embodiment here where the pivot points are created by mating apertures connected by bolts. For example, in other embodiments the pivot points may be comprised of mating engagements on opposing surfaces, such as divots with corresponding protuberances.

Locking Mechanism 160

The locking mechanism 160 in this embodiment has an adjustable stop threaded mounts 162, threaded bolts 164, safety pins 165, and stop panel 170. A threaded bolt 161 secures the threaded mount 162 to the plate 130 through the sides. Along the top of the mount 162 are bolt connections 163 which matingly engage the threaded shaft end of the threaded bolts 164. On an opposite end of the threaded bolts 164 is an aperture 168 which matingly engages the safety pin 165. The safety pin 165 has a hinge 167 which has a pin ring 166 for easy removal and attachment.

The threaded bolts 164 extend through apertures 172 in the lock panel 170 which sits across the lift arm 140 and side plates 130. The lock panel 170 is secured to the lift arm 140 via bolts 176. In order to more securely fasten the lock panel 170 when the lift arm 140 is in a downward position, the threaded bolts 164 extend through apertures in the deck 40. In order to extend through the deck 40, the threaded bolts 164 have a length of between 10 and 2 inches, preferably between 8 and 4 inches, and more preferably, about 6 inches. The lock panel 170 has wings 174 which extends past on either side past the plates 130. The apertures 172 which extend through the lock panel 170 being positioned through the wings 174.

In the embodiment shown here, the locking mechanism is shown on the upper surface of the main deck 40. However, it is to be understood that these locking mechanisms could easily be placed along the sides 41 of the main deck, so long as they were capable of locking the lift arm 140 into position with respect to the main deck 40.

Piston 180

The piston 180 has a main body 183 and piston shaft 186. The piston 180 can rotate slightly about a first pivot point 181 at a first body end 182 opposite a second body end 184. The second body end 184 being adjacent a first shaft end 185. The first shaft end 185 being opposite the second shaft end 187 being connected to links 150, 156 at pivoting point 154. The piston body 183 has two piston valve 189 which are connected and powered in the customary manner and so are not further discussed herein.

In this embodiment, the piston is a hydraulic piston, however, it is to be understood that similar activating pistons may be used if the appropriate countermeasures are taken to ensure proper force is exerted.

Deck Extensions 200

Deck extensions 200 are supported on the lift arms 140 of the deployment system 110. In many ways, the deck extensions 200 are simply smaller yet distinct portions of decking, being disparate from the main deck 40. The main deck 40 of the pontoon boat may have a width of up to 102 inches, and the deck extensions 200 shown in this embodiment may have a width of between 8 to 30 inches, and more preferably a width of about 18 inches. The main deck 40 of the pontoon boat may have a length of between 120 to 324 inches. The deck extensions 200 shown in this embodiment may similarly have a length of between 120 to 324 inches, and more preferably a length of about 144 inches.

It is to be understood that the length of the deck extensions 200 may be greater than the length of the main deck 40 so long as the piston 180 is of sufficient strength to support the additional weight. Regardless, the overall surface area of an active deck, being a virtual combination of the deck extensions 200 and the main deck 40, increases when the deck extensions 200 are fully deployed. The overall surface area may increase between 10 to 40 percent, and more preferably, about 25 percent.

In some embodiments, these deck extensions 200' (shown in FIG. 2) are not only adjustable via rotation, but they are also removable. These deck extensions 200' are not permanent fixtures on the lift arm 140. Specifically, in some embodiments, the end 146 or even intermediate portion of the lift arm 140 may be used as storage space 202 for deck extensions 200' which are removable.

In these embodiments, the deck extensions 200' have an attachment component 204 which may be reattached to corresponding attachment portions 45 found on the front 43 of the pontoon deck 40 and thereby serve as boarding ramps for transporting the equipment on and off the main deck 40 while docked, beached, or landed. In the embodiment shown in FIG. 2, these interoperating attachment components are simple hooks 204 and corresponding deck holes 45 which are capable of interacting. While an interference fit may be used, in most embodiments the force of gravity is sufficient to act as a simple yet reversible locking mechanism, holding the deck ramp 200' in place during use.

Additionally, even when embodiments are in a first configuration such as shown in FIG. 1, a space 202 is formed between the deck 40 and deck extensions 200. Additional deck extensions 200' may be stored in this space 202 during highway transportation via releasable bolts to the lift arms (not shown). Thus, these embodiments would have both fixed adjustable deck extensions 200, and releasable deck extensions 200' which can act as boarding ramps for equipment while docked.

Method of Activating

When activating the deployment system 110, the piston 180 acts upon the other components of the deployment system 110 in order to transition the pontoons and the lift arm 140 from the first to second positions as shown progressively in FIGS. 4-7.

Figure 4:
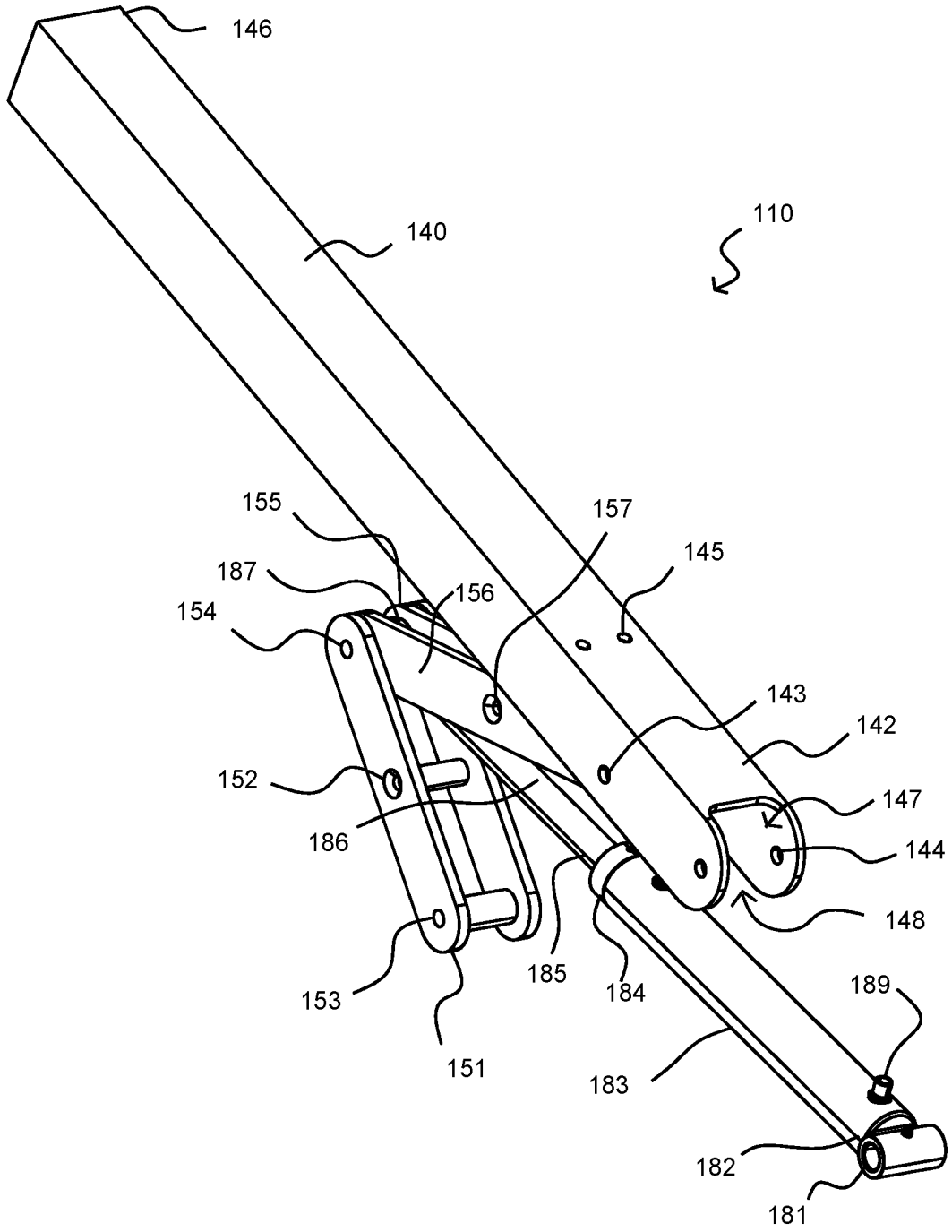
FIG. 4 is a perspective view of the interacting components of the deployment system of FIG. 3 shown in the second configuration.
Figure 5:
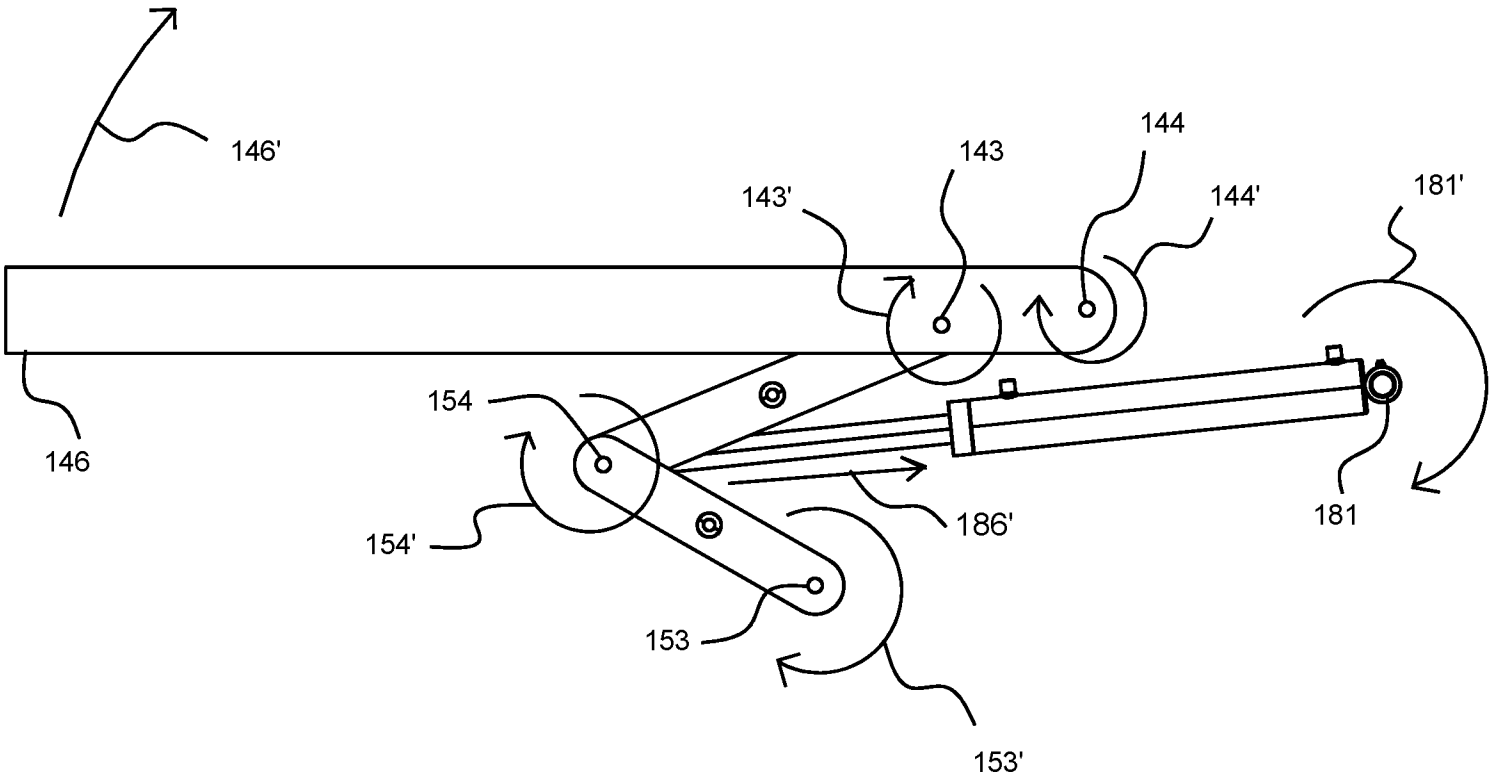
FIG. 5 is a front view of the interacting components of the deployment system of FIG. 3 shown in the second configuration.
Figure 6:
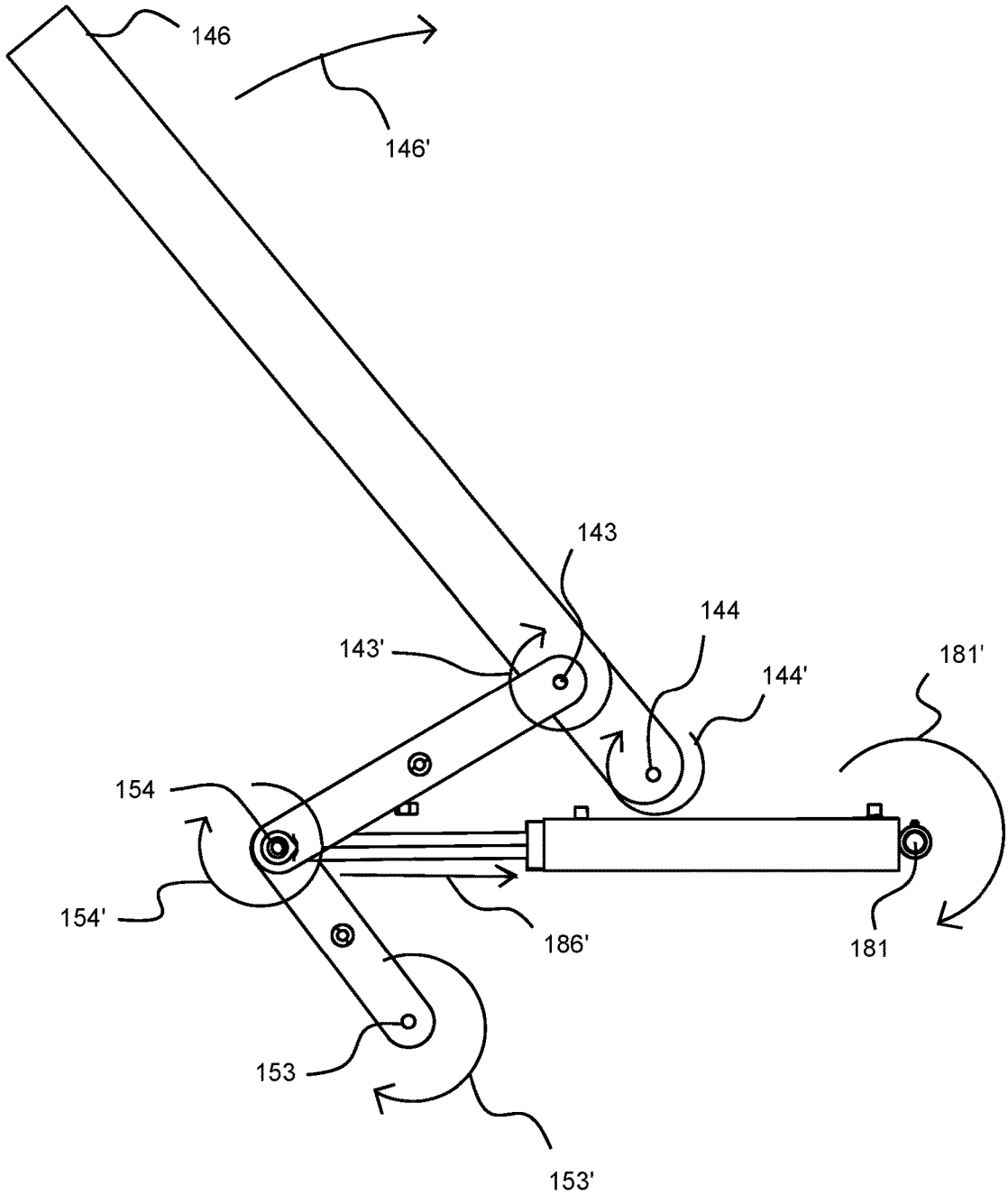
FIG. 6 is a front view of the interacting components of the deployment system of FIG. 3 shown transitioning from the second configuration.

Specifically, FIGS. 4-7 illustrate the deployment system transitioning from the second configuration associated with FIG. 2 to the first configuration associated with FIG. 1. In FIG. 4, the lift arm 140 of the deployment system 110 extends fully outward, the piston being fully deployed. In FIG. 5, the piston has started to retract 186', causing clockwise rotational movement about several interconnected pivoting points 181, 153, 154, 143, 144 due to the structural connections between these pivoting points 181, 153, 154, 143, 144. In FIG. 6, the piston continues to retract 186', still causing clockwise rotational movement about several interconnected pivoting points 181, 153, 154, 143, 144. Finally, in FIG. 7, the piston has retracted 186' causing the furthest end 146 of the lift arm 140 to be fully rotated 146'.

The multiple interconnected pivoting points 181, 153, 154, 143, 144 enable only a small amount of retraction 186' to be translated into a large rotational movement 146' of the furthest end 146 of the lift arm 140. In the embodiment shown, the aperture in the deck 40 enables this a rotational movement 146' of the furthest end 146 of the lift arm 140 of about 90 to 140 degrees. In alternative embodiments, the deployment system 110 fully extends past the side walls 41 of the deck 40 instead of extending through apertures 42 in the deck 40. In these embodiments, the amount of rotational movement 146' depends upon length of the extension past the side walls 41 and can be between of about 90 to about 170 degrees.

Table with List of Referenced Elements

The following reference numbers are adhered to within the specification to refer to those referenced elements within the drawings of the present application.

TABLE 1

| Reference Numbers | |
|---|---|
| Pontoons, nonadjustable 10 | Short link, first end 151 |
| Trailer 20 | Short link, center 152 |
| Hitch 30 | Short link, first pivot 153 |
| Deck 40 | Short link, second pivot 154 |
| Deck side 41 | Long link, first pivot 155 |
| Deck aperture 42 | Long link 156 |
| Deck front 43 | Long link, midpoint 157 |
| Deck, under surface 44 | Long link, second pivot 158 |
| Deck, hole 45 | Locking mechanism 160 |
| Pontoon Extension System 100 | Lock, threaded bolt 161 |
| Deployment system 110 | Lock, threaded mount 162 |
| Plate 130 | Lock, threaded nut 163 |
| Plate, aperture 131 | Lock, threaded bolt 164 |
| Plate, first end 132 | Lock, safety pin 165 |
| Plate inner surface 133 | Lock, pin ring 166 |
| Plate, curvature 134 | Lock, hinge 167 |
| Plate, indent 135 | Lock, bolt hole 168 |
| Plate, second end 136 | Lock, bolt threaded part 169 |
| Plate, third pivot 137 | Lock, panel 170 |
| Plate, second pivot 138 | Lock, aperture 172 |
| Plate, apertures 139 | Lock, latch 174 |
| Lift arm 140 | Lock, bolt 176 |
| Lift arm, second end 142 | Lock, stop 178 |
| Lift arm, first pivot 143 | Piston 180 |
| Lift arm, second pivot 144 | Piston, pivot 181 |
| Lift arm, aperture 145 | Piston, body first end 182 |
| Lift arm, first end 146 | Piston, body 183 |
| Lift arm, first vent 147 | Piston body, second end 184 |

TABLE 1-continued

| Reference Numbers | |
|---|---|
| Lift arm, second vent 148 | Piston, first shaft end 185 |
| Short link 150 | Piston, shaft 186 |
| Piston, second shaft end 187 | Connecting bars, apertures 191 |
| Piston, two valves 189 | Connecting bar, horizontal 192 |
| Connecting bars, pontoon 190 | Connecting bars, deck support 195 |
| Connecting bars, apertures 191 | Deck, extensions 200 |
| Connecting bar, horizontal 192 | Deck, removable extensions 200' |
| Piston, second shaft end 187 | Deck, storage space 202 |
| Piston, two valves 189 | Deck, hook 204 |
| Connecting bars, pontoon 190 | Pontoons, adjustable 210 |

CONCLUSION

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An adjustable pontoon system for a pontoon boat with a main deck and at least two pontoons, the adjustable pontoon system comprising:

an adjustable pontoon capable of being positionally adjusted with respect to the main deck of the pontoon boat, the main deck being fixed and nonadjustable;

a lift arm having a first end and a second end opposite the first end, the first end secured to the main deck of the pontoon boat and the second end fixedly supporting the adjustable pontoon; and a deployment system capable of facilitating movement of the lift arm with respect to the main deck of the pontoon boat, the movement of the lift arm translating into movement of the adjustable pontoon from a first traveling position to a second use position, such that the adjustable pontoon system has a first traveling configuration in which the lift arm extends upward at an angle with respect to the main deck of the pontoon boat thereby raising the adjustable pontoon above the main deck, and a second use configuration in which the lift arm extends parallel to the main deck of the pontoon boat;

wherein the deployment system being located underneath the main deck when in the second use position.

2. The adjustable pontoon system of claim 1 further comprising at least one deck extension capable of being adjusted with respect to the main deck of the pontoon boat; the second end of the lift arm supporting the deck extension; such that the movement of the lift arm translating into movement of the adjustable pontoon also translates into movement of the deck extension from a first position to a second position, and in the first traveling configuration the deck extension extends abnormal to the main deck of the pontoon boat, and in the second use configuration the deck extension extends parallel to the main deck of the pontoon boat.

3. The adjustable pontoon system of claim 1 further comprising a piston capable of activating the deployment system thereby facilitating rotation of the deployment system about at least one rotation point.

4. The adjustable pontoon system of claim 1 further comprising a locking mechanism capable of securely locking, holding, and maintaining the adjustable pontoon system in at least one of the first and second configurations.

5. An adjustable pontoon boat comprising:

a nonadjustable pontoon having a first width and a first length;

a main deck, being fixed and nonadjustable, having a first width and a first length;

an adjustable pontoon system comprising:

an adjustable pontoon capable of being positionally adjusted with respect to the main deck of the pontoon boat;

at least one deck extension connected to the at least one adjustable pontoon; and a deployment system capable facilitating movement of the at least one adjustable pontoon and the at least one deck extension from a first position to a second position, such that the adjustable pontoon system has a first traveling configuration in which the at least one deck extension and adjustable pontoon extends upward and abnormal to the main deck of the pontoon boat thereby raising the adjustable pontoon above the main deck, and a second use configuration in which the at least one deck extension extends parallel to the main deck of the pontoon boat;

wherein the deployment system being located underneath the main deck when the deployment system is in the second configuration.

6. The adjustable pontoon boat of claim 5 further comprising a piston capable of activating the deployment system thereby facilitating rotation of the deployment system about at least one rotation point.

7. The adjustable pontoon boat of claim 5 further comprising a locking mechanism capable of securely locking, holding, and maintaining the adjustable pontoon system in at least one of the first and second configurations.

8. A method of adjusting a width of a pontoon boat, the pontoon boat having a main deck being fixed and non-adjustable with a first non-adjustable pontoon, the method comprising:

providing an adjustable pontoon system having an adjustable pontoon, and a deployment system;

activating the deployment system and facilitating movement of the adjustable pontoon;

altering a position of the adjustable pontoon from a first use position being parallel relative to the main deck, to a second traveling position being above relative to the main deck; and positioning the deployment system such that when in the first use position, the entirety of the deployment system is positioned underneath an upper surface of the main deck.

9. The method of claim 8, wherein the step of providing the adjustable pontoon system further comprising a step of: supporting the adjustable pontoon on a rotatable lift arm of the deployment system.

10. The method of claim 9, wherein the step of activating the deployment system further comprising: connecting the lift arm to the main deck by at least one pivot; activating a piston to act upon the lift arm; and rotating the lift arm around the at least one pivot by at least 30 degrees.

* * * * *